US005306188A

United States Patent [19]

Skedeleski et al.

[11] Patent Number: 5,306,188

[45] Date of Patent: Apr. 26, 1994

[54] METHOD OF APPLYING A SAFETY/MANEUVER ENHANCING FIN TO A SURFBOARD

[75] Inventors: David Skedeleski; Eric Arakawa, both of Aiea, Hi.

[73] Assignee: Surfco Hawaii, Aiea, Hi.

[21] Appl. No.: 60,649

[22] Filed: May 13, 1993

Related U.S. Application Data

[63] Continuation-in-part of Ser. No. 788,459, Nov. 6, 1991, Pat. No. 5,273,472.

[51] Int. Cl.[5] ..... A63C 15/06

[52] U.S. Cl. ..... 441/79; 114/140

[58] Field of Search ..... 441/74, 79; 114/39.2, 114/140, 127, 162

[56] References Cited

U.S. PATENT DOCUMENTS

| | | | |
|---|---|---|---|
| 3,082,444 | 3/1963 | Estes . | |
| 3,428,980 | 2/1969 | Newton . | |
| 3,543,315 | 12/1970 | Hoffman | 428/116 |
| 3,585,957 | 6/1971 | Rich | 114/140 |
| 3,804,049 | 4/1974 | Greer | 114/67 A |
| 3,890,661 | 6/1975 | Johnson | 441/79 |
| 4,129,911 | 12/1978 | McDonald et al. | 441/74 |
| 4,209,867 | 7/1980 | Abrams, III | 441/74 |
| 4,325,154 | 4/1982 | Collum, Jr. | 441/74 |
| 4,720,280 | 1/1988 | Hufnagl et al. | 441/74 |
| 4,904,215 | 2/1990 | Sherwood | 441/79 |
| 4,923,427 | 5/1990 | Roland | 441/79 |
| 5,014,955 | 5/1991 | Thompson | 441/74 |
| 5,038,698 | 8/1991 | Winner | 114/39.2 |
| 5,242,322 | 9/1993 | Chellemi et al. | 441/74 |

FOREIGN PATENT DOCUMENTS

| | | | |
|---|---|---|---|
| 79113 | 5/1983 | European Pat. Off. | 114/140 |

*Primary Examiner*—Jesus D. Sotelo

*Attorney, Agent, or Firm*—Nixon & Vanderhye

[57] ABSTRACT

A surfboard fin intermediate ha a rigid body element with flexible material (e.g. rubber) covering the leading and trailing edges, with a protective material—such as aluminum foil tape—readily removably secured to the flexible material on a small part of the body element to substantially completely cover the flexible material to protect it during manufacture of a surfboard with the fin attached, such as during sanding. The fin with protective material is placed so that the base engages the bottom of a surfboard, resin impregnated fiberglass rope or roving is applied to the base of the fin and the surfboard bottom spaced from the flexible material, and then resin impregnated fiberglass cloth is applied to the fin and bottom surface of the surfboard. After the resin dries, most of the fiberglass cloth exterior of the fin is cut away with a blade, and then any unwanted portions of the fiberglass cloth associated with the fin are sanded away. Then the protective material is removed from the fin, e.g. by stripping the tape off.

22 Claims, 8 Drawing Sheets

30
28
14
13
16
16
10
11
12
14
22
114
113
111
116
33
110
112
114
36
214
213
211
34
216
210
212
214
28
23
28
29
31

Fig. 5
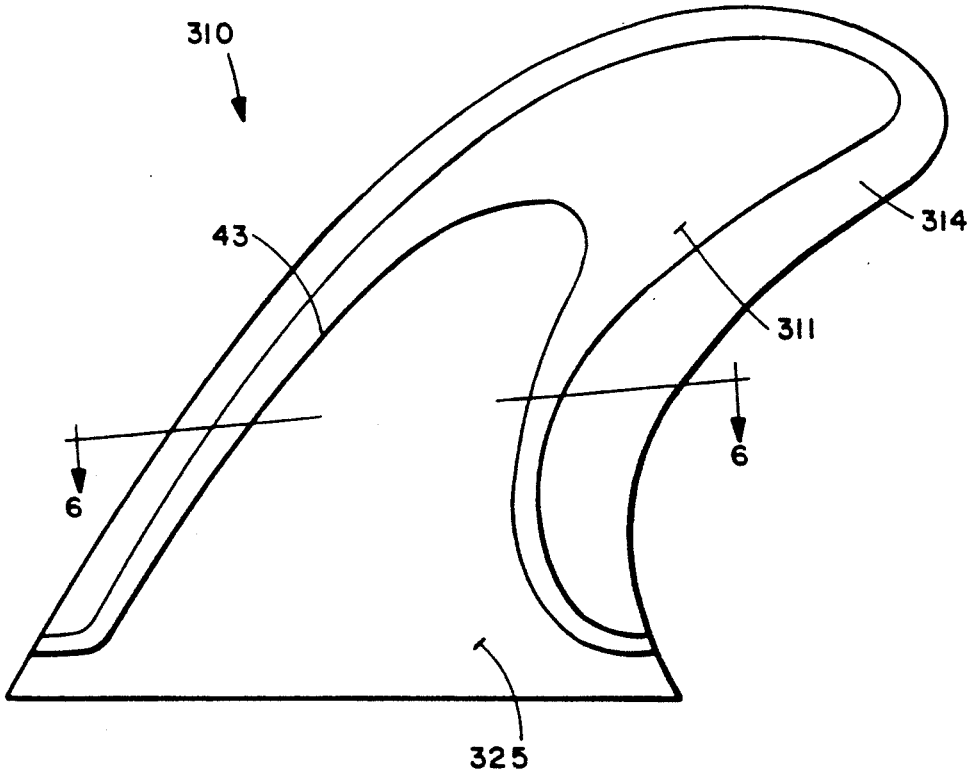
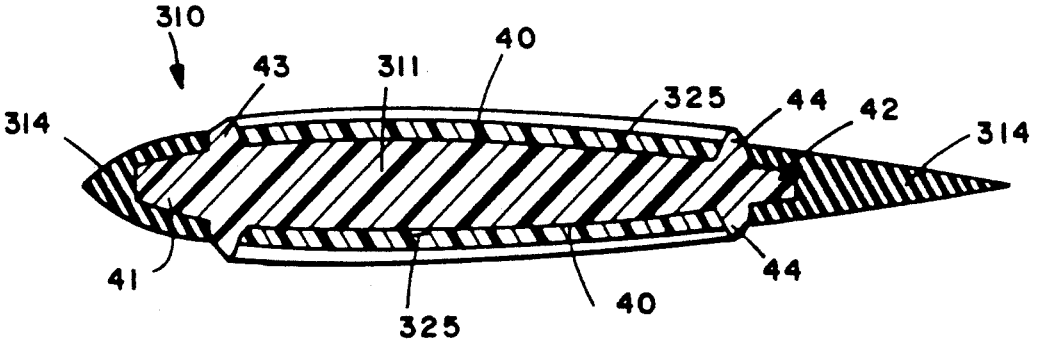
Fig. 6

Fig. 7
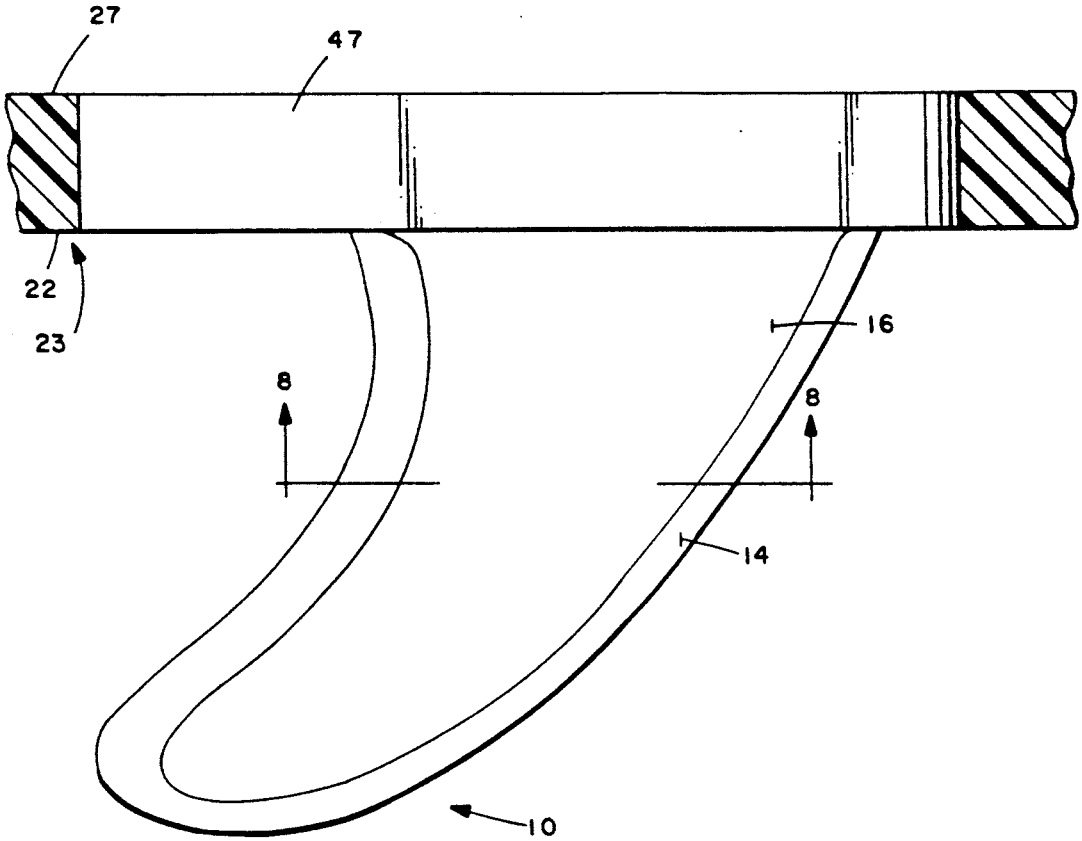
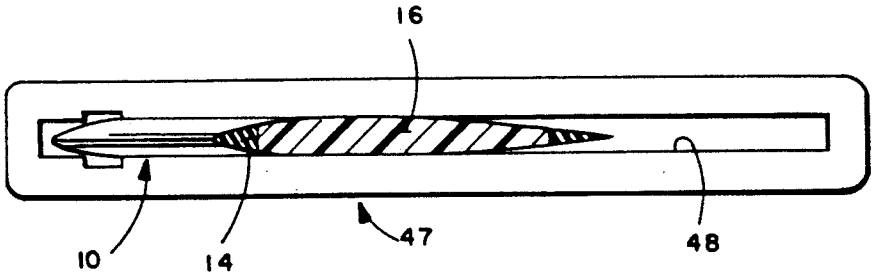
Fig. 8

FIG. 12
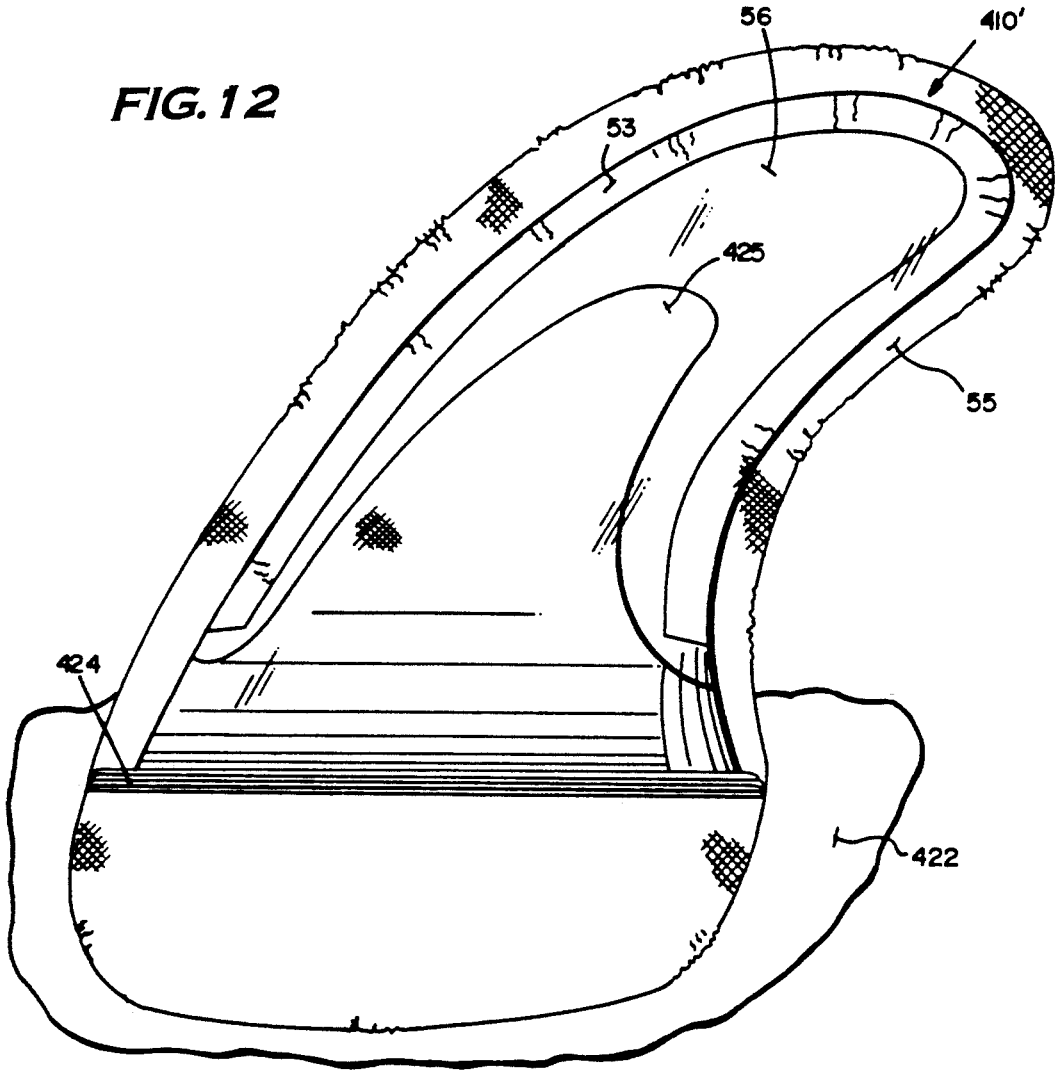
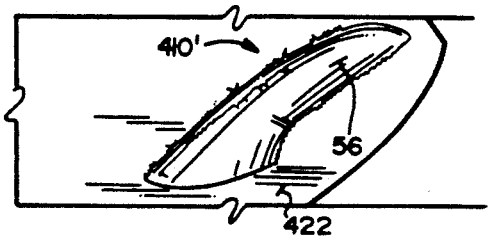
FIG. 13

METHOD OF APPLYING A SAFETY/MANEUVER ENHANCING FIN TO A SURFBOARD

CROSS REFERENCE TO RELATED APPLICATION

This application is a continuation-in-part of application Ser. No. 07/788,459 filed Nov. 6, 1991 now U.S. Pat. No. 5,273,.

BACKGROUND AND SUMMARY OF THE INVENTION

Modern surfboards desirably include a fin adjacent the tail thereof, and along the centerline of the board, to provide dimensional stability, to maximize board performance. While conventional fins are certainly useful for that purpose, they pose two significant problems. One is that the fin can be dangerous to surfers or nearby swimmers if the surfboard is travelling at high speed and the leading or trailing edge of the fin hits the surfer or swimmer. Also, while providing good dimensional stability, a fin may, depending upon the circumstances, restrict maneuverability.

According to the invention in the parent application a surfboard fin, and a surfboard, are provided which overcome the problems inherent in the prior art. According to the most basic aspects thereof, a surfboard fin or fins are provided which have soft, flexible leading and trailing edges so that if they impact a surfer or swimmer the injury will be minimized. The flexible material at the trailing edge of the fin or fins also provides a rudder action to provide maneuverability to a surfer standing on the top surface of the board and shifting his/her weight. Although numerous advantages are obtained by utilizing a single tail fin, preferably a plurality of fins are provided, e.g. three fins spaced at particular locations adjacent the tail of the board.

According to one aspect of the invention of the parent application a surfboard tail fin is provided comprising: A rigid body element having a leading edge, and a trailing edge; and a flexible material covering disposed on the leading and trailing edges of the rigid body element. The flexible material is soft enough to minimize injury to a person impacted by a leading or trailing edge of the fin, and is flexible enough to be deflected by water pressure during surfing to provide a rudder action. Preferably the rigid body element is of a hard plastic having a Shore D hardness of at least about 60 (and preferably at least about 78), while the flexible material is a soft plastic (such as a urethane or silicone) having a Shore A hardness of about 40–100 (preferably about 40–94), a thickness on the trailing edge of about 0.2–0.4 inches, and a thickness on the leading edge of about 0.2–0.4 inches.

According to another aspect of the invention in the parent application a surfboard is provided having a top surface and a bottom surface, a front end (nose), and a rear end (tail). The surfboard includes at least one tail fin extending downwardly from the bottom surface adjacent the rear end. The fin comprises a rigid body element having a leading edge, and a trailing edge; and a flexible material covering disposed on the leading and trailing edges of the rigid body element, the covering material having sufficient thickness, softness and flexibility to minimize injury to a person impacted by a leading or trailing edge of the fin, and to be deflected by water pressure during surfing to provide a rudder action (anti-cavitation action) as a surfer shifts his or her weight on the top surface of the surfboard.

The surfboard according to the parent application has a centerline between the front and rear ends, and preferably has three fins. A first fin is provided closest to the tail and disposed on the centerline, with the second and third fins disposed further from the tail than the first fin and off the centerline. The second and third fins are disposed approximately the same distance from the tail as each other and approximately the same distance from the centerline and on opposite sides of it, and have flat inner side faces. The leading and trailing edges of the first fin are substantially coplanar with the center plane containing the centerline. The second and third fin leading and trailing edges are in planes which makes a slight angle (e.g. about 2°–10°) to the centerline, the leading edges being slightly closer to the centerline than the trailing edges. Also the center plane is substantially vertical when the board is in use, while the planes containing the leading and trailing edges of the second and third fins are slightly off vertical (e.g. about 2° to 15°).

The fins utilized according to the invention may be manufactured by a wide variety of techniques, including by: molding both the rigid and the flexible plastics together at the same time; injection molding the flexible plastic onto the rigid plastic once it has been formed (the preferred manner); or cutting and contouring sheets or strips of flexible material and adhesively connecting them to the edges of the rigid material.

The fins may be connected to the surfboard by primarily conventional techniques utilizing fiberglass rope and fiberglass cloth impregnated in resin, the fiberglass rope extending along all portions of the enlarged base of the rigid plastic element of the fin, while the fiberglass cloth extends up along the sides of the rigid plastic portion of the fins. The preferred manner of attaching the fin to the surfboard to ensure proper rigid connection of the fin to the bottom of the surfboard, while also ensuring that there is no damage to the flexible material comprises the steps of substantially sequentially: (a) Placing a protective material on the fin so that it substantially completely covers the flexible material of the fin, but only a small portion of the rigid body element. (b) Applying resin impregnated fiberglass rope or roving to the base of the fin, spaced from the flexible material, and the bottom of the surfboard. (c) Applying resin impregnated fiberglass cloth to the fin and the bottom surface of the surfboard so that the cloth substantially covers the fin. (d) Cutting away most of the fiberglass cloth exterior of the fin. (e) Abrading the fiberglass cloth off of the fin at areas thereof covering the flexible material and portions thereof covering the rigid body element where it is undesired, the protective material protecting the flexible material from significant damage during the abrading action. And, (f) removing the protective material from the fin so that the flexible material is exposed.

Step (a) is preferably practiced by placing a foil (e.g. aluminum) tape with pressure sensitive adhesive over the flexible material, and step (f) is practiced by pulling the tape from the fin. After step (f) any pressure sensitive adhesive adhering to the flexible material is removed with solvent. Mold release agent, such as pva, may be applied to the external surface of the protective material if necessary, although the surface of aluminum foil releases sufficiently so that a mold release agent is normally not necessary therewith.

Step (c) is preferably practiced by applying two to three layers of translucent fiberglass cloth, and step (e) is practiced by sanding with a power sander. Desirably the sides of the rigid body of the fins have a ridge formed thereon, and steps (d) through (f) are practiced to remove substantially all fiberglass cloth between the ridges and the leading and trailing edges, and step (e) is practiced using the ridges as guides during sanding. Steps (a) through (f) may be practiced for at least one other fin (e.g. for three fins total).

As seen above, it is highly desirable to protect the flexible material during the manufacture of the surfboard with the fin according to the present invention thereon. It has been found that if the flexible material is not sufficiently protected, especially during the sanding step, significant damage can be done thereto. One way that this can be avoided is to apply a protective material to the fin immediately after it is manufactured, and before it is sent to the surfboard manufacturer for incorporation into the surfboard.

According to another aspect of the present invention, a surfboard fin intermediate, used to make a final surfboard, is provided. The intermediate comprises the following elements: A rigid body element having a leading edge, a base, and a trailing edge. A flexible material covering disposed on the leading and trailing edges of the rigid body element, spaced from the base, the flexible material being soft enough to minimize injury to a person impacted by a leading or trailing edge of the fin, and being flexible enough to be deflected by water pressure during surfing to provide a rudder, anti-cavitation, action. And, a protective material having protective properties sufficient to protect the flexible material from damage during manufacturing processes, including sanding, readily removably secured to the flexible material and a small part of the body element to substantially completely cover the flexible material to protect it during manufacture of a surfboard with surfboard fin attached thereto.

Preferably the protective material comprises thin metallic sheet material deformed to bend over and cover the flexible material, most preferably a metal (aluminum) foil tape secured by pressure sensitive adhesive. The tape preferably has a thickness of about 4–9 mils, and has a width of about one-half inch to one inch (preferably $\frac{3}{4}$–$\frac{5}{8}$ inch). Pva, or another mold release agent, may be applied to the external surface of the protective material if necessary to facilitate its release from the fiberglass cloth.

The fin rigid body element has first and second side faces and a substantially continuous ridge formed on each side face spaced from the flexible material, and a recessed side surface disposed within the perimeter of each of the ridges for receiving fiberglass cloth therein. The small part of the rigid body element to which the protective material is secured is outside the perimeters of the ridges.

According to yet another aspect of the present invention a surfboard, having top and bottom surfaces, a front end, and a rear end is provided. The surfboard also comprises: At least one fin extending downwardly from the bottom surface adjacent the rear end, the fin comprising: a rigid body element having a leading edge, a base, side faces, and a trailing edge; a flexible material selected from the group consisting essentially of rubbers, silicone, and urethanes disposed on the leading and trailing edges, spaced from the base, the thickness on the leading edge being about 0.2–0.4 inches, and the thickness on the trailing edge being about 0.2–0.4 inches; and a substantially continuous ridge extending outwardly from each of the side faces between the base and the flexible material. And, resin impregnated fiberglass holding the base and the side faces within the perimeter of the ridges to the bottom surface of the surfboard, to thereby rigidly hold the fin in position with respect to the surfboard.

It is the primary object of the present invention to provide a method of manufacture of a surfboard having a fin with enhanced safety and maneuverability characteristics, and to provide a fin intermediate particularly useful for that purpose. This and other objects of the invention will become clear from an inspection of the detailed description of the invention and from the appended claims.

BRIEF DESCRIPTION OF THE DRAWINGS

FIG. 5 is a side view of a second embodiment of an exemplary fin according to the invention;

FIG. 6 is a cross-sectional view taken along lines 6—6 of FIG. 5;

FIG. 7 is a side elevational view of the fin of FIG. 1 in a fin box mounted within a surfboard, the surfboard being shown in cross-section;

FIG. 8 is a bottom plan view of the fin and fin box of FIG. 7 with the fin sectioned along lines 8—8;

FIG. 12 is a view like that of FIG. 11 only showing the fin intermediate of FIG. 11 in an intermediate stage when it is "glassed" onto the bottom of a surfboard; and FIG. 13 is a view like that of FIG. 12 showing the fin after the excess fiberglass surrounding the perimeter of the fin has been cut away, but before sanding.

DETAILED DESCRIPTION OF THE DRAWINGS

Figures 1, 2:
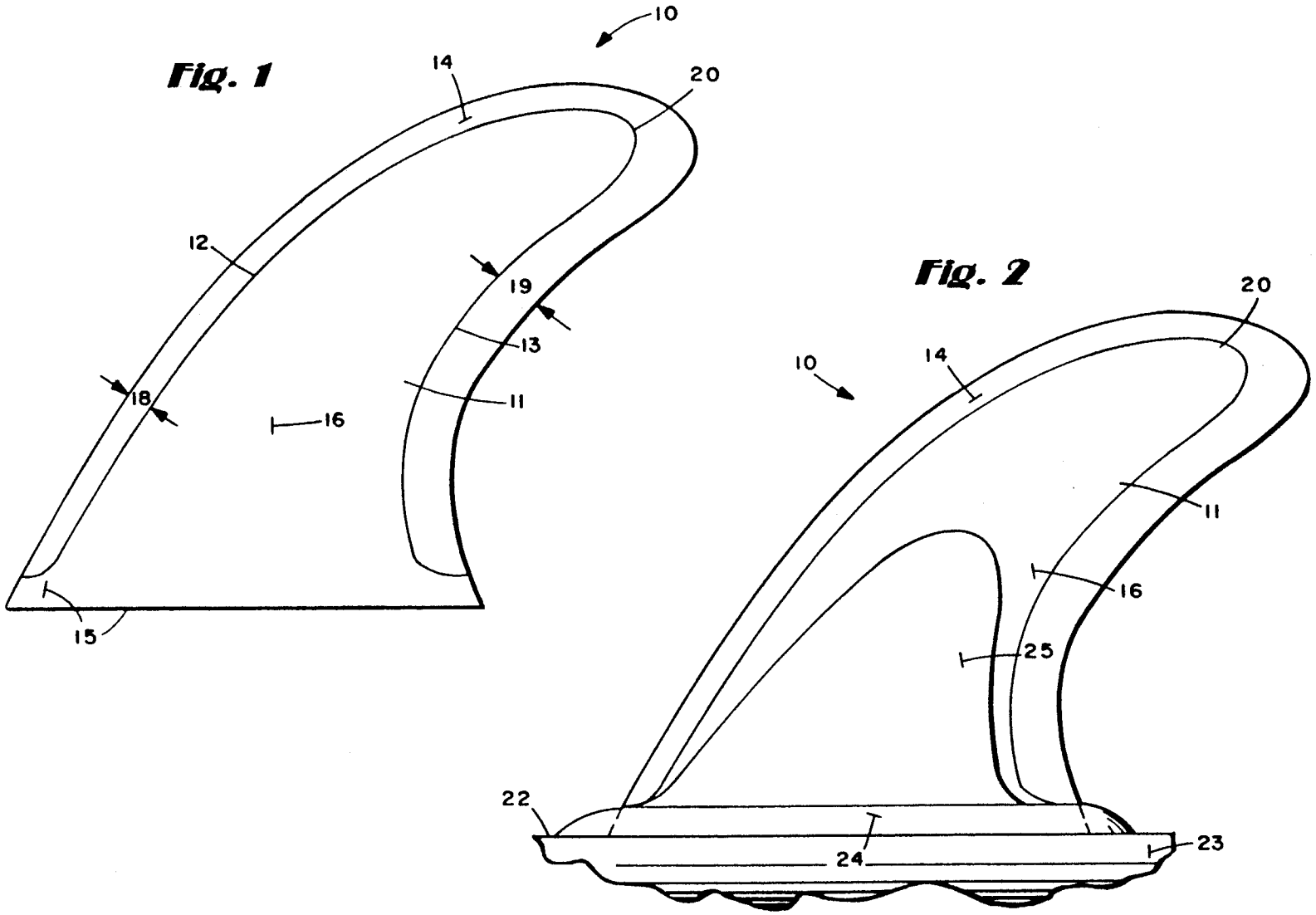
FIG. 1 is a side view, essentially actual size in scale, of an exemplary fin according to the present invention.
FIG. 2 is a side view of the fin of FIG. 1 shown connected to the bottom of a surfboard.

An exemplary fin according to the present invention is shown generally by reference numeral 10 in the drawings. The fin preferably consists essentially of two basic components, a rigid plastic body element 11 having a curved leading edge 12, and a curved trailing edge 13, and a soft, flexible elastomeric material covering 14 disposed on the edges 12, 13, except at the enlarged width base 15 of the rigid element 11. The element 11 has a pair of side faces 16 (see FIGS. 1 and 4), which are slightly convex (i.e. foil shaped) and it is preferred that the soft flexible material 14 not cover substantial (or even any) portions of the side faces 16.

The rigid, hard plastic element 11 may be made of a wide variety of materials, but it is highly desirable that the material be entirely compatible with fiberglass cloth and rope, which preferably are used to secure the fin 10 on a surfboard. The material of element 11 also preferably is compatible with the soft flexible plastic forming the material 14 so that the two do not have a tendency to separate in use. Preferably the hard plastic element 11 has a Shore D hardness of at least about 60, and preferably at least about 78. For example it may be a 2102 series (e.g. 2102-80D) polyester polycaprolactone such as sold under the trademark Pellethane®.

The soft flexible material 14 preferably is rubber, or a plastic such as a silicone or a urethane, but regardless of the material it has sufficient softness so as to minimize injury to a person impacted by a leading or trailing edge of the fin 10, and it is flexible enough to be deflected by water pressure during surfing to provide a rudder action (anti-cavitating action). That is, it has a thickness, softness, and flexibility to perform these functions, the rudder action being provided as a surfer shifts his or her weight on the top surface of the surfboard with which the fin 10 is associated. While a wide variety of materials may be utilized, preferably the flexible elastomeric material 14 has a Shore A hardness of about 40–100 (preferably about 40–94), such as provided by a class of polyurethane elastomers sold under the Pellethane® trademark, comprising 2102 series polyester polycaprolactones, designations 2102-75A, 80A, 80AE, 85A, 90A, and 90AB.

In a preferred embodiment, the thickness 18 of the material 11 along the leading edge 12 is at least about 0.1 inches, and preferably about 0.2–0.4 inches (e.g. about 0.25 inches), while the thickness 19 along the trailing edge 13 is preferably also about 0.2–0.4 inches (e.g. about 0.25–0.375 inches).

While the shape of the fin 10 may vary, a particularly useful shape is that illustrated in the drawings, wherein the leading edge 12 curves back toward the trailing edge 13, and the edges 12, 13 intersect at a rounded tip 20 remote from the surfboard. The tip 20 also is covered by the flexible material 14, as illustrated.

The fin 10 according to the invention may be constructed in a number of different ways. For example depending upon the equipment and the materials utilized and available, the hard plastic element 11 and the soft plastic edges 14 can be injection molded at the same time. Alternatively, a hard plastic element 11 may be inserted in a mold disposed along the edges thereof, and the flexible material 14 molded in place. Still further, sheets or strips of urethane or silicone can be cut and shaped so that they correspond to the edges 12, 13 of the element 11, and they may be attached in place on the edges 12, 13 with a compatible adhesive.

Figure 3:
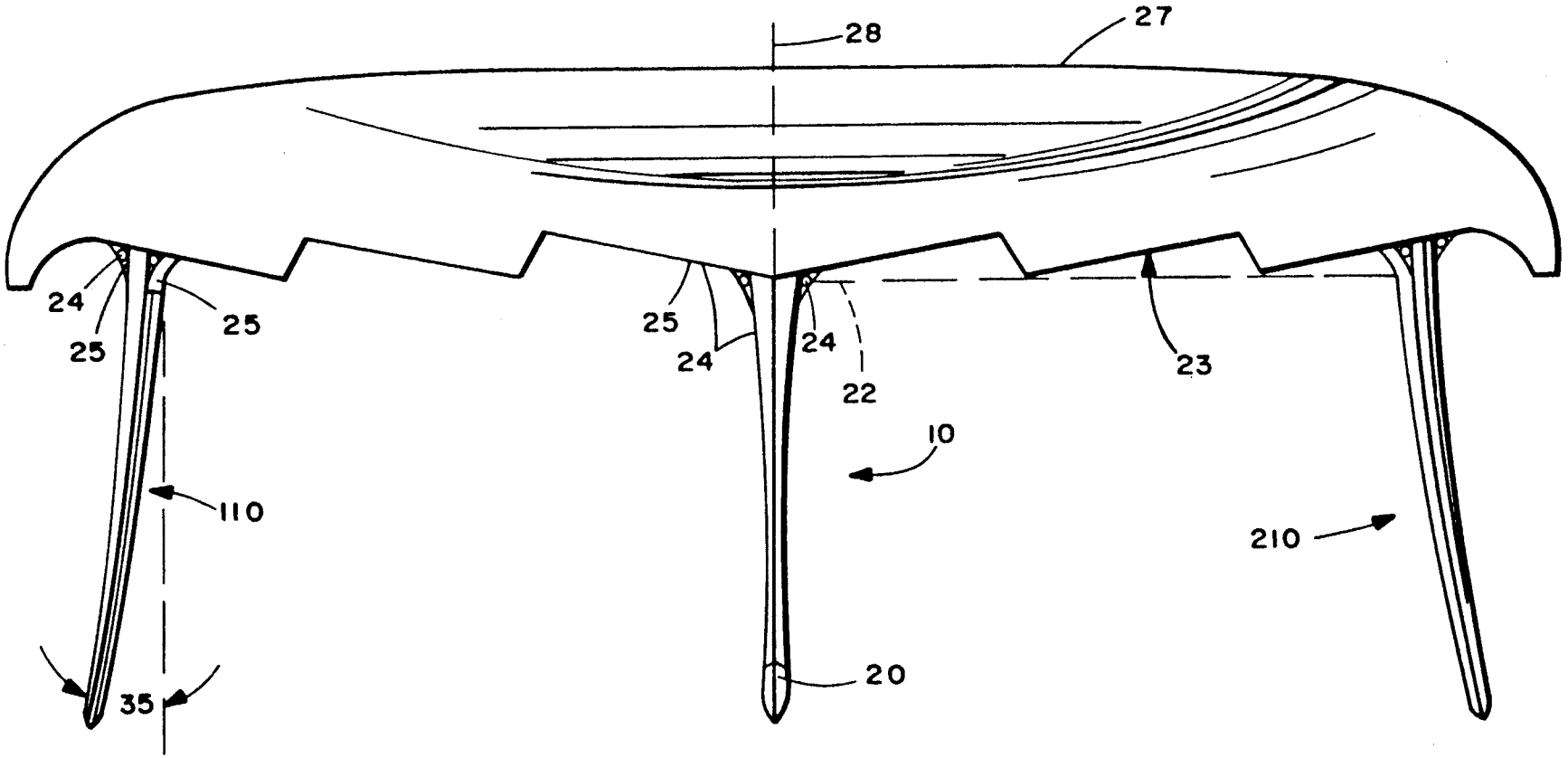
FIG. 3 is a rear cross-sectional view of a surfboard having three fins similar to those of FIGS. 1 and 2, during construction.

FIGS. 2 and 3 illustrate one way in which the fin (or fins) 10 is attached to a bottom surface 22 of a surfboard 23. It is to be understood that in the present specification and claims that the term "surfboard" is to be interpreted broadly to encompass what are colloquially known as surfboards, windsurfing boards, water ski boards, and the like; that is the term "surfboard" encompasses all water sport boards which may use a fin.

The manner in which the fin 10 according to the invention is applied to the surfboard bottom surface 22 is basically conventional. That is fiberglass rope 24 (see FIG. 2) soaked in resin is applied along both sides of the fin 10 at the base 15, while fiberglass cloth 25, soaked in resin, is applied upwardly along the sides 16. Such a construction essentially ensures that the fin 11 is integral with the board, and forms a part of it, with no unnecessary drag as a result of connection of the fin 10 to the board 23.

Figure 4:
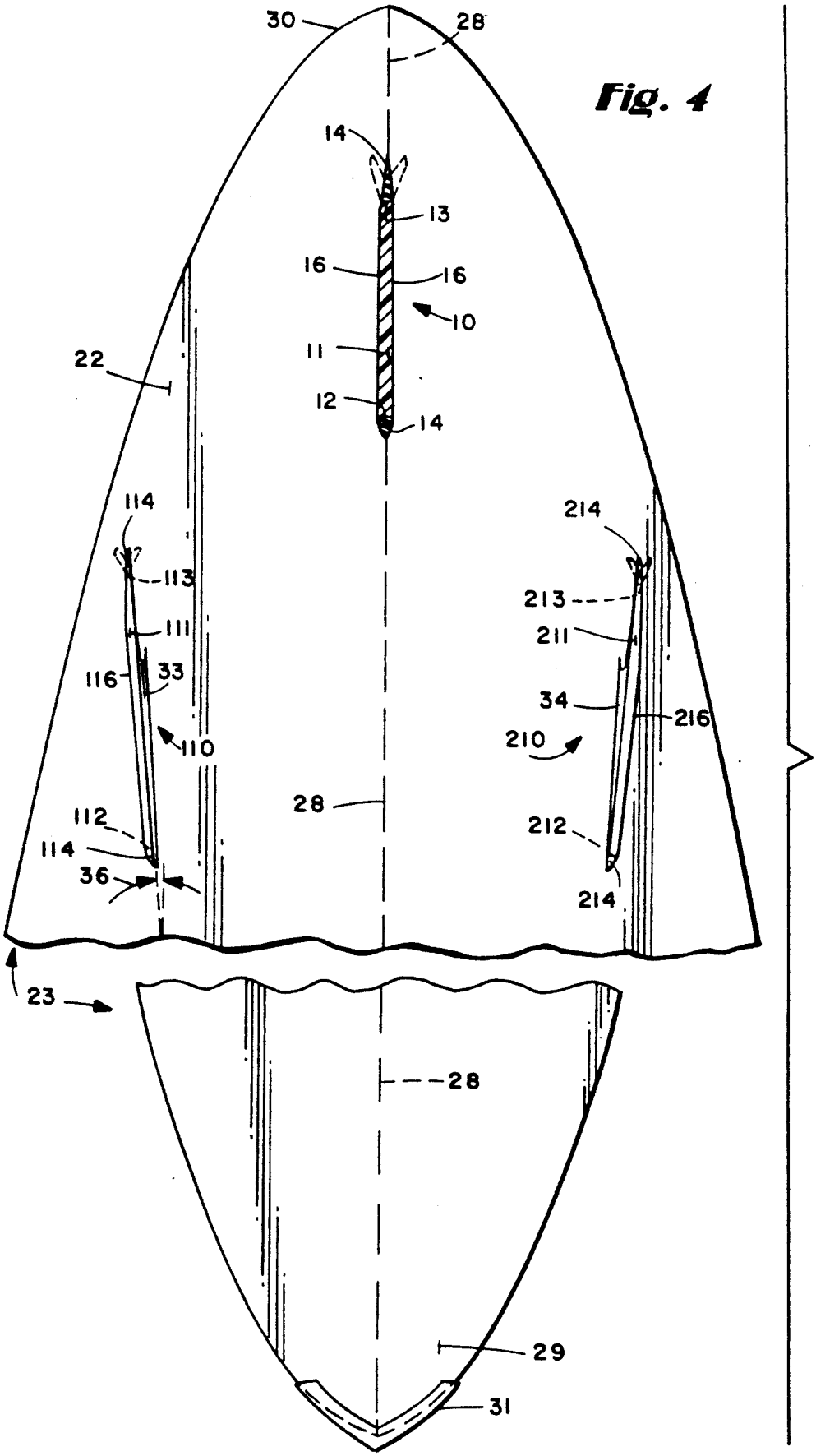
FIG. 4 is a bottom view of a final surfboard like that of FIG. 3 with the fins sectioned along horizontal planes, and showing the flexible trailing edges in dotted line position, illustrating a rudder effect.

The particular orientation of one or more fins according to the present invention with respect to a surfboard 23 is illustrated in FIGS. 3 and 4. The surfboard 23 has a bottom surface 22 (FIGS. 2 through 4), and a top surface 27 (see FIG. 3). The surfer stands or kneels or lays on the top surface 27. The board 23 also has a centerline 28, a front portion (nose) 29, and a rear portion (tail) 30 (see FIG. 4). Preferably the pointed tip of the nose 29 has a protective tip 31, such as shown in U.S. Pat. No. 4,792,316, the disclosure of which is hereby incorporated by reference herein.

As can be seen in both FIGS. 3 and 4, preferably the fin 10, comprising a first fin, is disposed along the centerline 28 of the surfboard 23, and is in substantially a vertical plane in use, that is a plane containing edges 12, 13 is substantially perpendicular to the bottom surface 22 of the surfboard 23.

According to the invention, the soft flexible material 14 does not adversely affect the performance characteristics of the board to any significant extent, while providing a surfer-protecting function. As a matter of fact, the maneuverability of the board is increased according to the invention. While the soft flexible material 14 along the leading edge 12 (see FIG. 4) provides a substantial protective function, minimizing the injury to surfers or swimmers impacted by the leading edge of the fin 10, the material 14 on the trailing edge 13 not only provides this protecting function but also provides a rudder action (anti-cavitation action). When the water pressure acts on the material 14 along the trailing edge 13 during surfing, the material 14 may flex to the dotted line positions illustrated in FIG. 4. Thus a surfer standing on the top surface 27 of the surfboard 23 can utilize this rudder action to steer/maneuver the surfboard 23 by shifting his or her weight on the surfboard 23.

While the utilization of one fin 10 according to the invention is highly advantageous, some surfers—depending upon skill level—will obtain optimum results by utilizing a plurality of fins (e.g. two, three, four, or five), such as the fins 110 and 210 in addition to the fin 10. The arrangement of three fins in FIG. 4 is known per se (for conventional rigid fins).

As seen in FIGS. 3 and 4, the fins 110, 210—comprising second and third fins—have the same basic construction as the fin 10 as far as the rigid plastic element 111 and 211 is concerned, and the soft flexible material 114, 214 on the leading edges 112, 212, respectively, and additional flexible material 114, 214 on the trailing edges 113, 213, respectively. The only things different about the fins 110, 210 are their flat (water release) inner faces 33, 34, respectively, and their placement on the bottom surface 22 of a surfboard 23.

The fin 10 is closer to the tail 30 than the fins 110, 210, and preferably the fins 110, 210 are spaced the same distance from the tail 30, and are disposed on opposite sides of the centerline 28, spaced equidistance from it. The fins 110, 210 are also preferably tilted slightly about both vertical and horizontal axes. That is they make a slight angle 35 (see FIG. 3) with respect to the vertical when the board is in use, the angle 35 preferably being about 2°–15°. Also, they make a slight angle 36 (see FIG. 4) with respect to the centerline 28 so that the trailing edges 113, 213 of each are spaced slightly further from the center line 28 than the leading edges 112, 212 thereof. The angle 36 preferably is about 2°-10°. That is, the fins 110, 210 are toed in for better performance (typically increased speed).

FIGS. 5 and 6 illustrate another embodiment of fin according to the invention, designed to readily accommodate "glassing" of the fin onto a surfboard. In the FIGS. 5 and 6 embodiment structures comparable to those in the FIG. 1 embodiment are illustrated by the same two digit reference numeral only preceded by a "3".

In the FIGS. 5 and 6 embodiment, the rigid plastic body element 311 of the fin 310 has concave side faces 40, a front portion 41, and a rear portion 42. The concave faces 40 are defined by the leading ridges 43 and trailing ridges 44, each set of ridges 43, 44 meeting at a top portion, as illustrated in FIG. 5. The flexible elastomeric material 314 is received by the front and rear portions 41, 42 as indicated in FIG. 6.

The slight ridges 43, 44 on the perimeter of the concave faces 40 of the fin 310 direct the resin impregnated fiberglass 35 away from the soft outer edges of the fin 310 defined by the material 314. When the fin 310 is sanded, the excess glass will be lifted away from the outer edges, making it easier to remove. The material 314 also may be coated with a releasing agent such as polyvinyl alcohol (pva) during construction to prevent the resin associated with the fiberglass 325 from adhering to it, therefore enhancing the ease of removal of excess glass and resin. The glass 325 of course attaches the fin 310 to the surfboard in the same manner as the glass 25, and may also be associated with fiberglass rope, or the like.

In the previous embodiments, the fins 10, 310, etc. have been shown as permanently affixed to a surfboard 23. Alternatively, though less preferable, the fins may be removable. As seen in FIGS. 7 and 8, the fin 10 is mounted in a conventional fin box 47, so that it is removable from the surfboard 23. The conventional fin box 47 has a channel 48 formed in the bottom thereof for receipt of the fin 10. The manner in which the fin 10 is removably held within the channel 48 is conventional, and may vary, and may be such as shown in U.S. Pat. No. 3,564,632 or U.S. Pat. No. 4,421,492.

Figure 9:
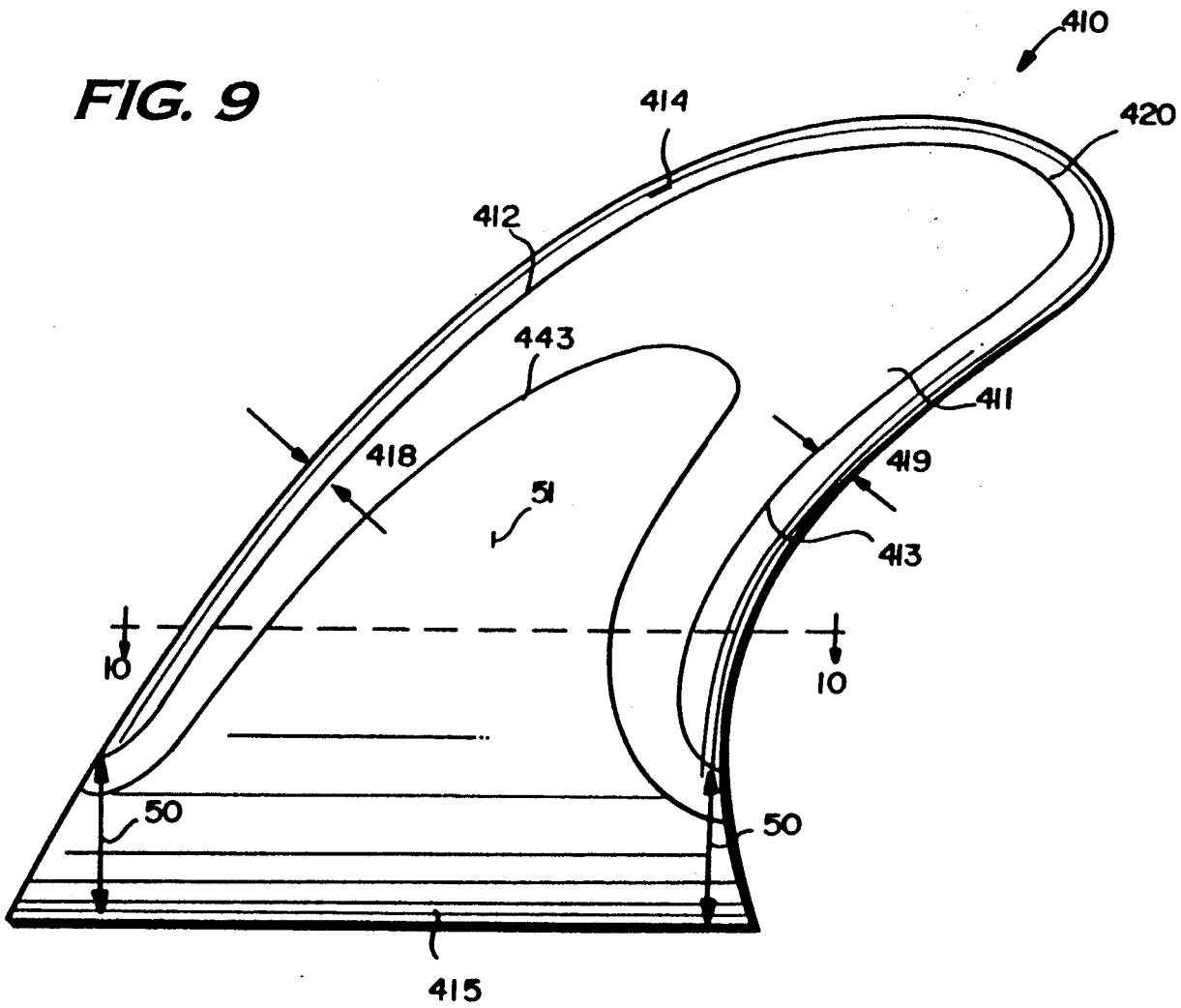
FIG. 9 is a view like that of FIG. 5 only for another exemplary embodiment of fin according to the present invention.

In the embodiment of the fin illustrated in FIG. 9 components comparable to those in the other embodiments are shown by the same two digit reference numeral only preceded by a "4".

Figure 10:
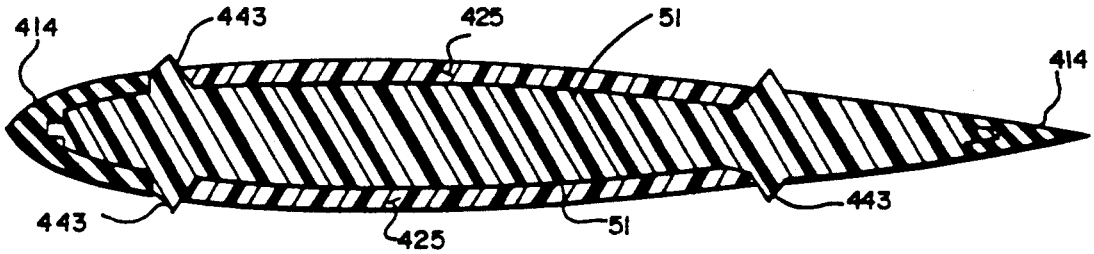
FIG. 10 is a cross-sectional view of the fin of FIG. 9 taken along lines 10—10 thereof, but with fiberglass cloth shown within the areas defined by the ridges.

The fin 410 has a rigid body 411, leading edge 412 and trailing edge 413 and flexible material 414, having a thickness 418 of about 0.25 inches and a thickness 419 of about 0.25 inches, and a base 415. Note that in this embodiment, the start of the flexible material 414 is spaced much more from the base 415 than in the FIG. 1 embodiment, the dimension 50 being about an inch or more. Also both of the side faces of the fin 410 (see FIGS. 9 and 10) have a continuous ridge 443 disposed between the base 415 and the flexible material 414, with recessed areas 51 within the perimeter of the ridges 443.

Figure 11:
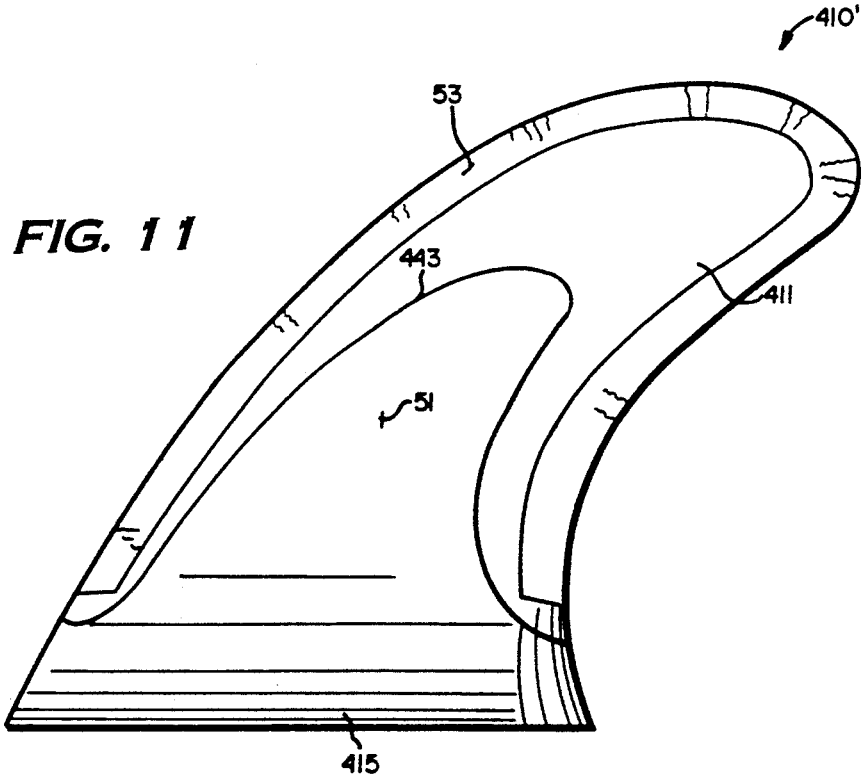
FIG. 11 is a side view of the fin of FIG. 9 constructed as a fin intermediate according to the invention, with foil tape covering the flexible material edges.

FIG. 11 illustrates an intermediate fin 410' according to the present invention which is the fin 410 from FIG. 9 with protective material applied to the flexible material. In the embodiment illustrated in FIG. 11, the protective material takes the form of the metal (aluminum) foil tape 53 which substantially completely covers the flexible material 414 and also covers a small part of the rigid body 411 immediately adjacent the material 414, and exterior of the perimeter of the ridges 443. One particularly desirable protective material 53 is heavy duty aluminum foil tape, which is abrasive resistant, such as that manufactured by 3M of Minneapolis, Minn. and sold under the trade designations No. 425 and No. 438. Such foil tape has pressure sensitive adhesive (e.g. acrylic adhesive) on the backside thereof, and has a thickness without adhesive of about 5.5 mils and with adhesive of about 7 mils. The aluminum tape utilized according to the invention preferably has a thickness of about 4-9 mils. The aluminum foil tape utilized according to the invention also preferably has a width of about one-half inch to one inch, typically about ¾-⅞ inch, and of course the width must be sufficient to substantially completely cover the flexible material 414, while not being so wide that it overlaps onto the ridges 443. Alternatively die cut aluminum foil tape can be used instead of the strips illustrated in the drawings.

FIG. 12 illustrates the use of the intermediate 410' from FIG. 11 during attachment thereof to the bottom surface 422 of a surfboard. First the fiberglass rope and/or roving 424 is applied to the base 415 of the fin intermediate 410', extending between the bottom surface 422 and the base 415 and being impregnated with resin so as to facilitate secure attachment of the fin intermediate 410' thereto. Then the board surface 422 and the fin intermediate 410' are further connected together by applying two to three layers of resin impregnated translucent fiberglass cloth so that the cloth substantially covers the fin intermediate 410'. Note that there is a portion 56 of the cloth which actually covers the fin, and other portions 55 that overlap the fin (extend past edges covered by material 414).

After the fin and board are in the configuration illustrated in FIG. 12, the resin is allowed to set, and then the excess glass 55, exterior of the fin, is cut away with a cutting blade. Then the fiberglass cloth is abraded (typically sanded with a power sander) off of the portions of the rigid body element 411 where the cloth is undesired, and also off of foil 53 (covering the flexible material 414). Most desirably, the ridges 443 are used as a guide by the person sanding the fiberglass cloth 56 so that in the recessed areas 51 within the perimeter of the ridges 443 the glass cloth remains, while substantially all of the glass cloth exterior of the ridges 443 is removed.

After removal of the unwanted glass cloth, by cutting and abrading, the protecting material 53 is removed from the flexible material 414, by peeling the tape off when the protective material 53 is aluminum foil tape or the like. Then any residue from the pressure sensitive adhesive remaining on the fin 410 is removed by a solvent (e.g. acetone), and then the final surfboard results. Of course the procedure described above can be repeated for as many fins as are necessary or desired.

Normally the aluminum foil tape 53 readily releases from the fiberglass, facilitating removal of the unwanted fiberglass, but where a protective material is used that does not readily release, the external surface thereof may be coated with a mold release agent such as pva.

It will thus be seen that according to the present invention a surfboard fin intermediate, and a surfboard with one or more fins, having enhanced safety and maneuverability, are provided, as well as a method of manufacture of a surfboard. While the invention has been herein shown and described in what is presently conceived to be the most practical and preferred embodiment thereof it will be apparent to those of ordinary skill in the art that many modifications may be made thereof within the scope of the invention, which scope is to be accorded the broadest interpretation of the appended claims so as to encompass all equivalent structures, devices, and methods.

What is claimed is:

1. A surfboard fin intermediate, used to make a final surfboard, comprising:

a rigid body element having a leading edge, a base, and a trailing edge;

a flexible material covering disposed on said leading and trailing edges of said rigid body element, spaced from said base, said flexible material being soft enough to minimize injury to a person impacted by a leading or trailing edge of said fin, and being flexible enough to be deflected by water pressure during surfing to provide a rudder, anti-cavitation, action; and a protective material having protective properties sufficient to protect the flexible material from damage during manufacturing processes, including sanding, readily removably secured to said flexible material and a small part of said body element to substantially completely cover said flexible material to protect it during manufacture of a surfboard with surfboard fin attached thereto.

2. An intermediate as recited in claim 1 wherein said protective material comprises thin metallic sheet material bent over and covering said flexible material.

3. An intermediate as recited in claim 1 wherein said protective material comprises aluminum foil tape secured by adhesive.

4. An intermediate as recited in claim 3 wherein said tape has a thickness of about 4–9 mils.

5. An intermediate as recited in 3 wherein said tape has pressure sensitive acrylic adhesive on a face thereof engaging said flexible material and rigid body element to adhesively secure said tape thereto.

6. An intermediate as recited in claim 4 wherein said tape has a width of about ½–1 inch.

7. An intermediate as recited in claim 4 wherein said tape has a width of about ¾–⅞ inch.

8. An intermediate as recited in claim 1 wherein said protective material comprises pressure sensitive adhesive tape having a width of about ½–1 inch.

9. An intermediate as recited in claim 1 wherein said protective material has an internal surface adhesively secured to said flexible material and said rigid body, and an external surface opposite said internal surface; and further comprising a mold release material applied to said protective material external surface.

10. An intermediate as recited in claim 9 wherein said mold release material is polyvinyl alcohol.

11. An intermediate as recited in claim 9 wherein said protective material comprises aluminum foil tape secured by adhesive.

12. An intermediate as recited in claim 1 wherein said fin rigid body element has first and second side faces, and a substantially continuous ridge formed on each side face spaced from said flexible material, and a recessed side surface disposed within the perimeter of each of said ridges, for receiving fiberglass cloth therein.

13. An intermediate as recited in claim 12 wherein said small part of said rigid body element to which said protective material is secured is outside the perimeters of said ridges.

14. A method of attaching at least one fin to a surfboard having top and bottom surfaces, the fin having a rigid body element with leading and trailing edges, and flexible material disposed on the leading and trailing edges spaced from a base portion of the fin, comprising the steps of substantially sequentially:

(a) placing a protective material on the fin so that it substantially completely covers the flexible material of the fin, but only a small portion of the rigid body element;

(b) applying resin impregnated fiberglass rope or roving to the base of the fin, spaced from the flexible material, and the bottom of the surfboard;

(c) applying resin impregnated fiberglass cloth to the fin and the bottom surface of the surfboard so that the cloth substantially covers the fin;

(d) cutting away most of the fiberglass cloth exterior of the fin;

(e) abrading the fiberglass cloth off of the fin at areas thereof covering the flexible material and portions thereof covering the rigid body element where it is undesired, the protective material protecting the flexible material from significant damage during the abrading action; and (f) removing the protective material from the fin so that the flexible material is exposed.

15. A method as recited in claim 14 wherein step (a) is practiced by placing a foil tape with pressure sensitive adhesive over the flexible material, and step (f) is practiced by pulling the tape away from the fin.

16. A method as recited in claim 15 wherein step (c) is practiced by applying 2–3 layers of translucent fiberglass cloth.

17. A method as recited in claim 14 wherein the protective material has an external surface, and comprising the further step, prior to step (c), of applying mold release material to the protective material external surface.

18. A method as recited in claim 14 wherein step (e) is practiced by sanding with a power sander.

19. A method as recited in claim 14 wherein the sides of the rigid body of the fin each have a ridge formed thereon, and wherein steps (d)–(f) are practiced to remove substantially all fiberglass cloth between the ridges and the leading and trailing edges, and wherein step (e) is practiced using the ridges as guides.

20. A method as recited in claim 14 comprising the further steps of repeating steps (a)–(f) for at least one other fin to apply it to the bottom of the surfboard.

21. A method as recited in claim 14 wherein step (a) is practiced utilizing pressure sensitive adhesive to hold the protective material to the fin, and comprising the further step (g), after step (f), of removing any pressure sensitive adhesive adhering to the flexible material with solvent.

22. A surfboard having a top surface and a bottom surface, a front end, and a rear end;

at least one fin extending downwardly from said bottom surface adjacent said rear end, said fin comprising: a rigid body element having a leading edge, a base, side faces, and a trailing edge; a flexible material selected from the group consisting essentially of rubbers, silicone, and urethanes disposed on said leading and trailing edges, spaced from said base, the thickness on said leading edge being about 0.2–0.4 inches, and the thickness on said trailing edge being about 0.2–0.4 inches; and a substantially continuous ridge extending outwardly from each of said side faces between said base and said flexible material; and resin impregnated fiberglass holding base and said side faces within the perimeter of said ridges to said bottom surface of said surfboard, to thereby rigidly hold said fin in position with respect to said surfboard.

* * * * *